US005697470A

United States Patent [19]

Carle

[11] Patent Number: 5,697,470

[45] Date of Patent: Dec. 16, 1997

[54] EXTENSIBLE STOWABLE LADDER DEVICE

[76] Inventor: Jack Carle, 14616 NE. 51st St., Vancouver, Wash. 98682

[21] Appl. No.: 691,933

[22] Filed: Aug. 5, 1996

[51] Int. Cl.[6] ..... A47B 77/10

[52] U.S. Cl. ..... 182/88; 312/235.1; 182/35; 182/91

[58] Field of Search ..... 182/88, 91, 97; 312/330.1, 334.1, 351, 237, 235.1

[56] References Cited

U.S. PATENT DOCUMENTS 3,481,429 12/1969 Gaede ..... 312/235.1 X 5,341,897 8/1994 Gross ..... 312/235.1 X

*Primary Examiner*—Alvin C. Chin-Shue
*Assistant Examiner*—Long Dinh Phan

[57] ABSTRACT

A ladder device with integral housing, hinges, and axle for use in conjunction with independent support structures. The device utilizes minimal space within the support structure, transfers the preponderance of loads to the floor, is adjustable for varied dimensional relationships and is adaptable to a plurality of locations within or upon the support structure. The device can be extended and deployed, used to extend a users reach height, and then stowed away within the housing without disturbing the use of the support structure.

2 Claims, 6 Drawing Sheets

EXTENSIBLE STOWABLE LADDER DEVICE

FIELD OF THE INVENTION

The present invention relates in general to a ladder device and particularly to extensible stowable ladder devices used in conjunction with independent support structures.

PRIOR ART

Kitchens are most often equipped with both lower and upper cabinets with the lower cabinets resting on the floor of the room and attached to the wall and the upper cabinets located a distance above the lower cabinets and related counter top. Typically the upper shelves of the upper cabinets are beyond the reach of most people and can only be accessed and/or viewed in their entirety by utilizing a stool, step, or ladder.

Many modern kitchens are also being designed with display shelves located above the upper cabinets. A common complaint is heard relative to the degree of difficulty involved in accessing elevated locations such as these without the use of stools, steps, or ladders. An additional complaint is commonly expressed wherein many stools, steps, or ladders are difficult to keep in the kitchen when not in use because they create clutter or obstacles within the room and must therefore be kept in a closet, store room, garage, or other inconvenient location when not in use and retrieved when needed.

Similarly, bathroom vanity cabinets are sized typically for older children and adults to use and small persons such as young children have difficulty reaching the sink without utilizing a stool or ladder which must also be stored when not in use. Most bathrooms have no convenient place to keep such a device without cluttering the room.

Numerous steps, ladders, and like devices have been installed within or upon independent support structures such as kitchen and vanity cabinets and the like. Said devices have been intended to assist persons in accessing objects placed above the height which could be reasonably and safely reached from the floor.

In order to provide background information so that the present invention may be completely understood and appreciated in its proper context, reference is made to a number of prior art patents as follows: U.S. Pat. Nos.: 5,341,897; 5,005,667; 4,846,304; 3,481,429; 5,094,515; 4,135,604; 3,756,678; and 3,743,320.

U.S. Pat. No. 5,341,897 to Gross discloses a foldable retractable step with limited adaptability to a plurality of alternate locations within or upon the independent support structure and no apparent method of adjustment to accommodate a number of dimensional relationships encountered in existing support structures.

U.S. Pat. No. 5,094,515 to Low discloses a folding step which attaches to the exterior surface of a vanity door. This device does not appear adaptable to a plurality of alternate locations relative to the support structure and a significant percentage of the load is exerted on a cabinet door with concomitant stress on the door hinges and latch.

U.S. Pat. No. 5,005,667 to Anderson discloses an extensible and retractable step assembly. This device does not appear adaptable to a plurality of alternate locations relative to the support structure, is of complex design with associated higher cost to manufacture resulting in a higher cost to the consumer, and requiring significant alteration of the support structure.

U.S. Pat. No. 3,743,320 to Clark discloses a vehicular step. This device does not appear adaptable to a plurality of alternate locations relative to the support structure and teaches no apparent means of adjustment to accommodate a plurality of dimensional relationships, and is of complex design with associated higher cost.

U.S. Pat. No. 4,846,304 to Rasmussen discloses a collapsible step apparatus for cabinet shelves. This device does not appear adaptable to a plurality of alternate locations relative to the support structure and has no apparent means of adjustment to accommodate a plurality of dimensional relationships.

U.S. Pat. No. 4,135,604 to Ryan discloses a vanity storing step. This device does not appear adaptable to a plurality of alternate locations relative to the support structure. When in the retracted position, this device would interfere with shelves within the cabinet, if present.

U.S. Pat. No. 3,756,678 to Klopfenstein teaches a retractable step. This device does not appear adaptable to a plurality of alternate locations relative to the support structure. When in the retracted position, this device would interfere with shelves within the cabinet, if present.

U.S. Pat. No. 3,481,429 to Gaede teaches a drawer step. This device does not appear adaptable to a plurality of alternate locations relative to the support structure, is of complex design with associated higher cost and installation would require significant modification of the independent support structure. Complexity of manufacture with associated higher cost to manufacture results in questionable affordability to the consumer. Loads while in use directed upon relatively fragile mechanisms such as pivot pins or fulcrums or downward loads on particle board shelves as often found in modern cabinetry reduces the load carrying capacity of a device and may create an unsafe condition or cause damage to the independent support structure. Some of the cited art discloses devices which can be installed only in the space between the bottom wall of the cabinet and the floor, attached to the exterior surface of the door or mounted only to a horizontal planary surface located a specific distance above the floor. Some disclose devices which when retracted and stowed can interfere with other structures typically located within the cabinet, vanity, or other independent support structure. Some of the prior art teaches devices that provide increments of vertical elevation which minimally assist the user in extending reach.

Modern cabinetry is often constructed of materials such as particle board which, when compared to the plywood often used in older cabinetry, has significantly lesser strength and load bearing capacity. Additionally, particle board is inferior to solid wood or plywood in screw holding capability and some prior art relies on fasteners holding in the supporting material.

Whatever the merits, features, and advantages of the cited references, none achieves or fulfills the purposes of the present invention.

A need exists for a ladder device which is of non complex construction with associated lower cost of manufacture and enhanced consumer affordability, which is adaptable to mounting in a plurality of alternative locations typically encountered in kitchen or vanity cabinets and the like, which is capable of supporting significant loads and transfers the preponderance of said loads against the floor while lessening the load placed on the wall or shelf of the structure to which it is attached, which when in use affords the user an increase in height in an amount which the user finds utilitarian and desireable, which can be retracted and stowed so as to interfere only minimally with other uses of the independent support structure, and which is capable of being installed in existing cabinets without undue or prolonged disruption of the daily use of same. The present invention provides such a device.

SUMMARY OF THE INVENTION

The present invention is an deployable, stowable ladder with integral hinges, integral axle pivot mechanism, and integral housing.

It is a principal object of the present invention to provide a ladder assembly which can be slidably withdrawn from and deployed out of the integral housing, remaining slidably joined to said housing while said housing is fastened to an independent support structure, pivoted upon the integral hinge and axle pivot mechanisms, have the ladder legs contact the floor in an angular relationship, and provide at least one rigid and sturdy step or rung horizontally spanning the distance between said ladder legs a desired distance from the floor and essentially parallel thereto upon which a user can place one or both feet, stand, and thereby conveniently reach places or objects located above an elevation that could be reached while standing on the floor.

It is furthermore an object of the present invention to be capable of transferring the preponderance of the load created by the weight of the user to the floor of the room within which the independent support structure is installed.

It is a further object of the present invention to be capable of being stowed within said integral housing while said housing is fastened within or upon a separate support structure such as a kitchen cabinet or bathroom vanity or the like without interfering with operation of doors, drawers, or the like associated with said support structures.

It is also an object of the present invention that the integral housing be capable of being attached in a horizontally relative position to a plurality of alternative locations within or upon the separate support structure inclusive of but not limited to the top surface of the lower planary surface also called the cabinet bottom, the underside of an intermediate planary surface also called a shelf, and between said lower planary surface or drawer and the floor of the room in the area commonly known as the kick space.

An object of the present invention is that the juxtaposition of the ladder legs, hinge, and hinge pivot mechanism be adjustable in order to accommodate a plurality of alternative locations at which the housing may be fastened to the independent support structure and in order to accommodate a variety of dimensional relationships.

A further object of the present invention is to utilize a minimal amount of space within the support structure and, when stowed, not unduly interfere with operation of the cabinet doors nor with the uses typically associated with kitchen cabinets or bathroom vanities such as storage of utensils or concealment of plumbing.

Another object of the present invention is to be of non-complex design so as to lend itself to economical manufacture from available materials and to be easily installed without the use of specialized tools or skills and without significant alteration to or prolonged disruption of the use of the independent support structure nor the room within which the support structure is located.

Other objects and advantages of the present invention will become more obvious hereinafter in the drawings and detailed description which follows.

DETAILED DESCRIPTION OF THE INVENTION

Figure 1:
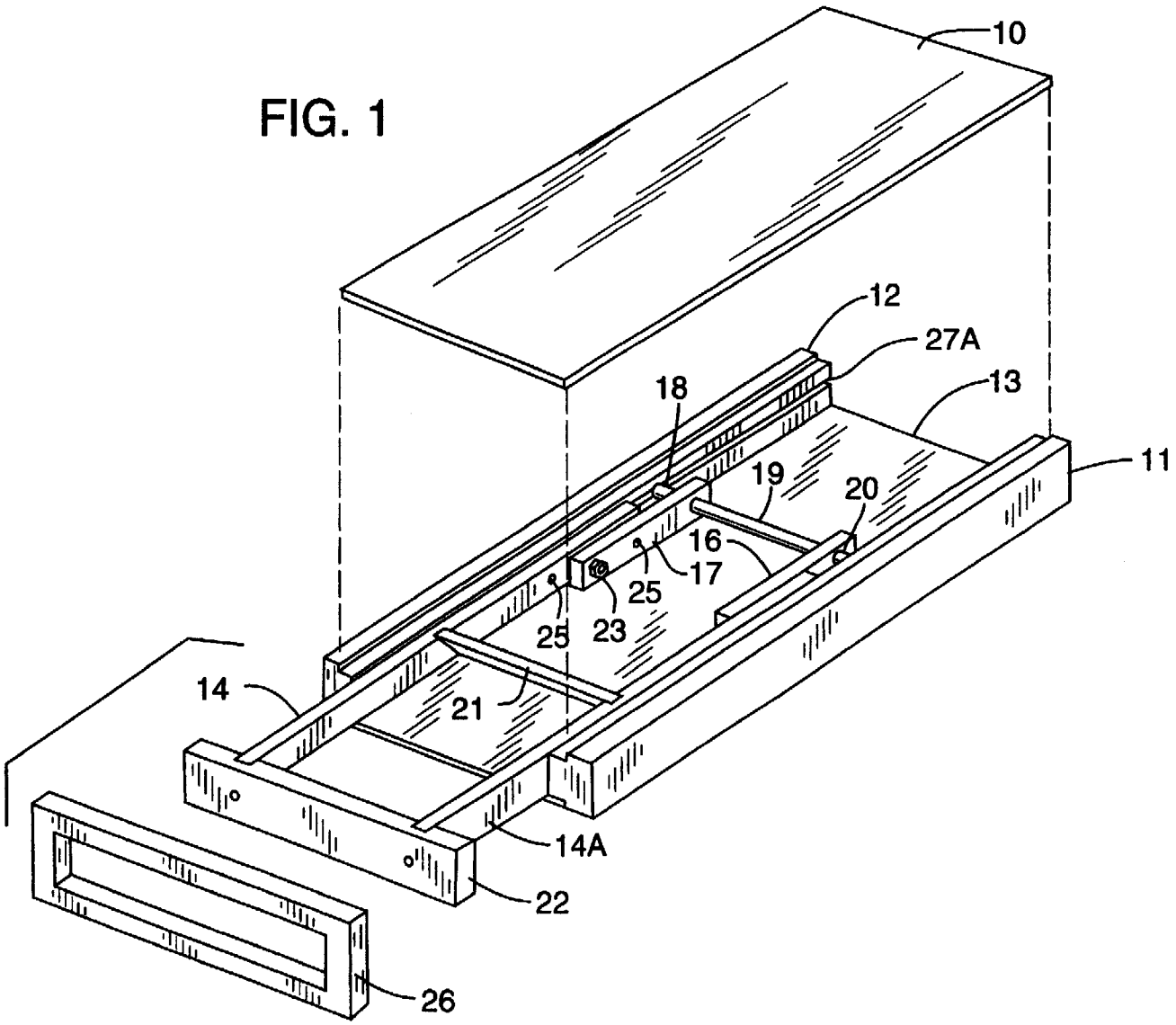
FIG. 1 of the drawings illustrates a perspective, partially exploded view, of the assembled invention with the top of the housing and the detachable face frame separated.
Figure 8C:
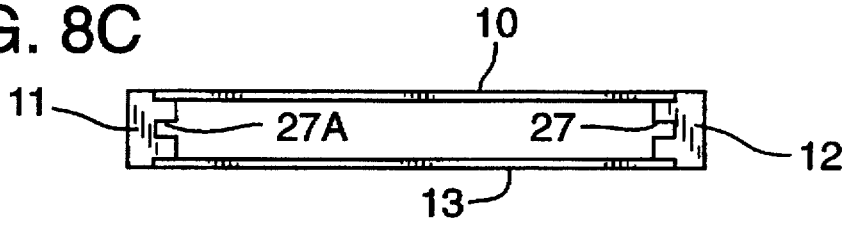
FIG. 8 of the drawings illustrates both a plan view, front elevation view, and rear elevation view of the housing and detachable face frame.
Figure 8A:
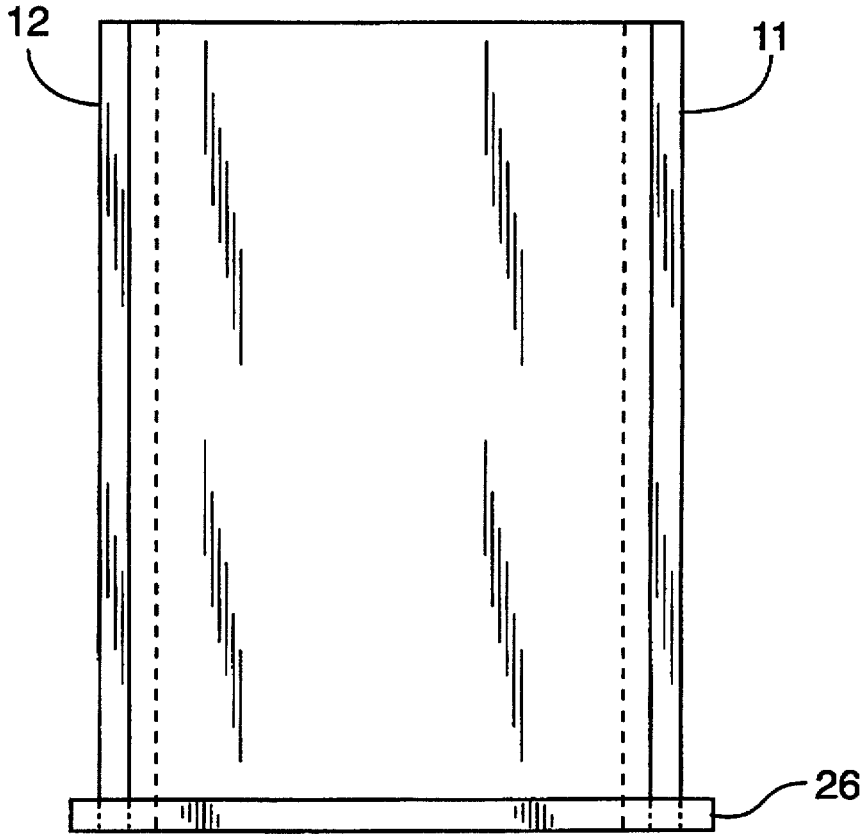
Figure 8B:
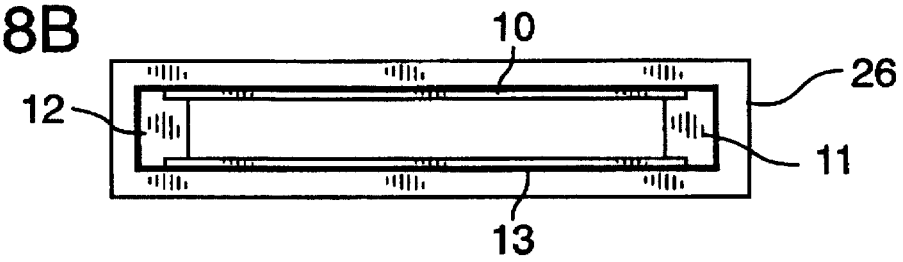

With reference now to the FIGURES, wherein like reference characters designate like parts throughout the several views and sections, FIG. 1 is a perspective view of the present invention with one side of the housing (10) removed and elevated in order that the assembly can be seen in detail and the detachable face frame (26) removed and separated. FIG. 1 illustrates the juxtaposition of the various parts when assembled, requiring only that the remaining side of the housing (10) be affixed to the rails (11 and 12) which form two sides of the housing in order to complete the assembly. Sides (10) and (13) could be replaced by cross pieces not covering the entire housing in an alternative embodiment. In some applications either side (10) or (13) could be removed if conditions of installation warrant. The fourth side of the housing assembly can be formed by a planary section (13) essentially similar in size and shape to (10) and similarly affixed to rails (11) and (12) which are mirror images one of the other. Said rails (11) and (12) are grooved along their facing surfaces said grooves (27 and 27A) being essentially parallel to the long axis of said rails (11 and 12) and essentially equidistant from the other two sides (10 and 13). This groove, which could be replaced with a surface mounted channel in an alternate embodiment, traverses from an end of the rails (11 and 12) toward the opposing end, stopping a distance before said opposing end and forming a combined track, support, and stop for the axle (15) which slidably joins the ladder assembly with the housing assembly. FIG. 8 illustrates details of the housing assembly with the detachable face frame (26) separated from the housing assembly. Said face frame (26) is provided to facilitate installation of the housing assembly in the embodiment of the invention illustrated in FIGS. 4 and 5 and is detached and removed when the invention is utilized in the embodiments illustrated in FIGS. 2, 3, 6 and 7. The embodiments of the present invention illustrated in FIGS. 2, 3, 6, and 7 have the housing assembly attached in alternate locations within and upon the support structure. In these locations the face frame is rendered disfunctional and not utilized.

Comprising the ladder assembly is an axle (15) which passes through a pair of hinges (16 and 17) and spacers (18, 19 and 20) thence into the groove in the parallel rails (11 and 12) of the housing assembly and thereby slidably joining the ladder assembly to the housing assembly and further providing a pivot and support for the hinges (16 and 17). The ladder assembly is further comprised of two parallel legs (14 and 14A), an intermediate horizontally supported rigid member (21) which forms the rung or step, and a rigid end member (22). In this embodiment of the invention only one rung or step is shown, but other embodiments could utilize more than one.

Figure 9B:
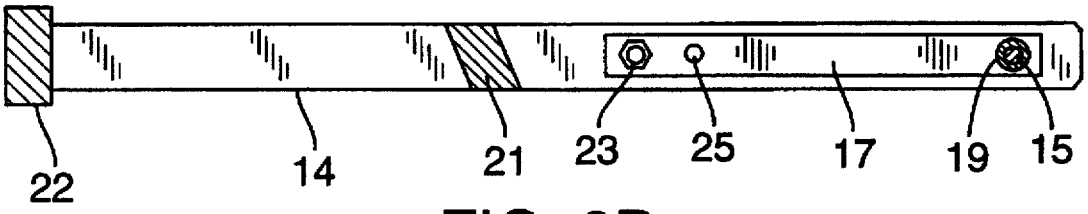
FIG. 9 of the drawings illustrates both a plan view and sectional view of the ladder assembly.
Figure 9A:
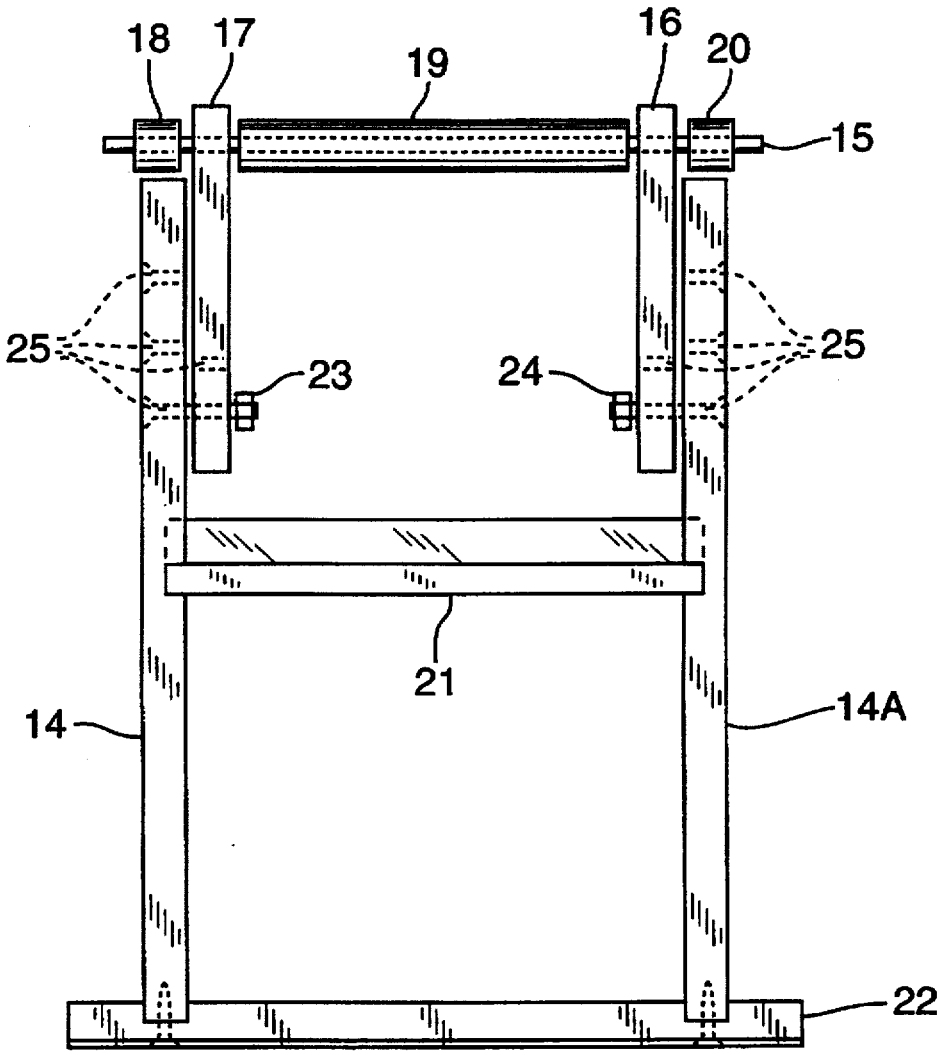

Reference is made to FIG. 9 which illustrates details of the juxtaposition of the various elements of the ladder assembly.

The hinges are attached to the ladder legs utilizing hinge attaching pins (23 and 24) which may be machine screws or bolts with self locking nuts. The heads of said hinge attaching pins must be thin enough or recessed into the ladder leg members sufficiently to prevent damaging contact between the head and the housing assembly side rails. Said attaching pins utilize any of the plurality of holes (25) present in the hinge members and ladder leg members as the relationship of the various elements and distances may dictate. The plurality of holes are sized to allow the hinge and leg elements to rotate around the hinge attaching pins and axle without binding.

The ladder legs are juxtaposed with the hinges and the housing assembly side rails in order to optimize the length of the rung. Portions of the axle between the hinge and the face of the housing assembly side rails and between the hinges are equipped with spacers appropriate to approximately maintain the space between the side rails and hinges and between the hinges.

Figure 2:
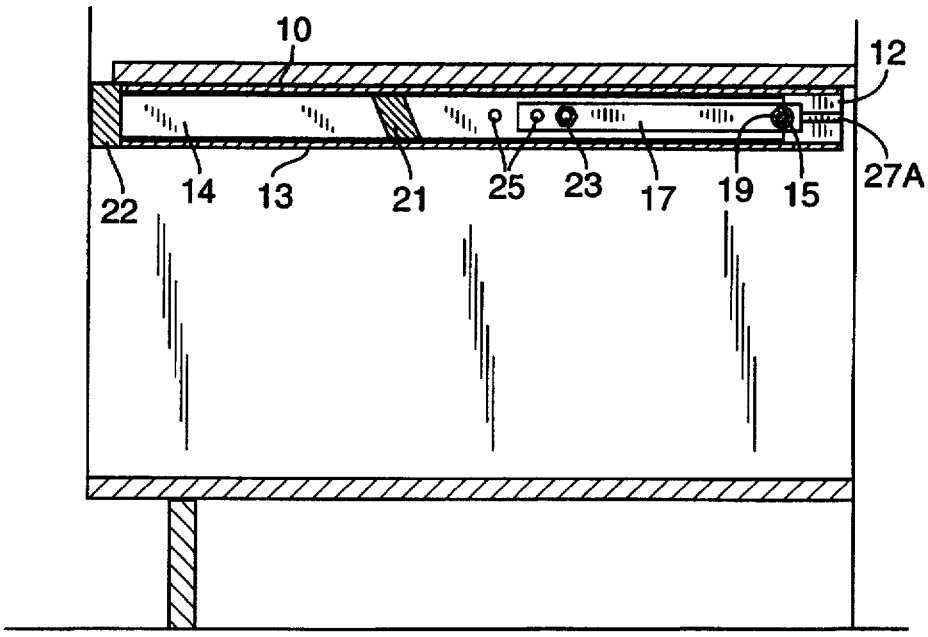
FIG. 2 of the drawings illustrates a sectional view of the ladder in the retracted and stowed position with the housing fastened beneath an intermediate shelf within a cabinet and the face frame removed.
Figure 3:
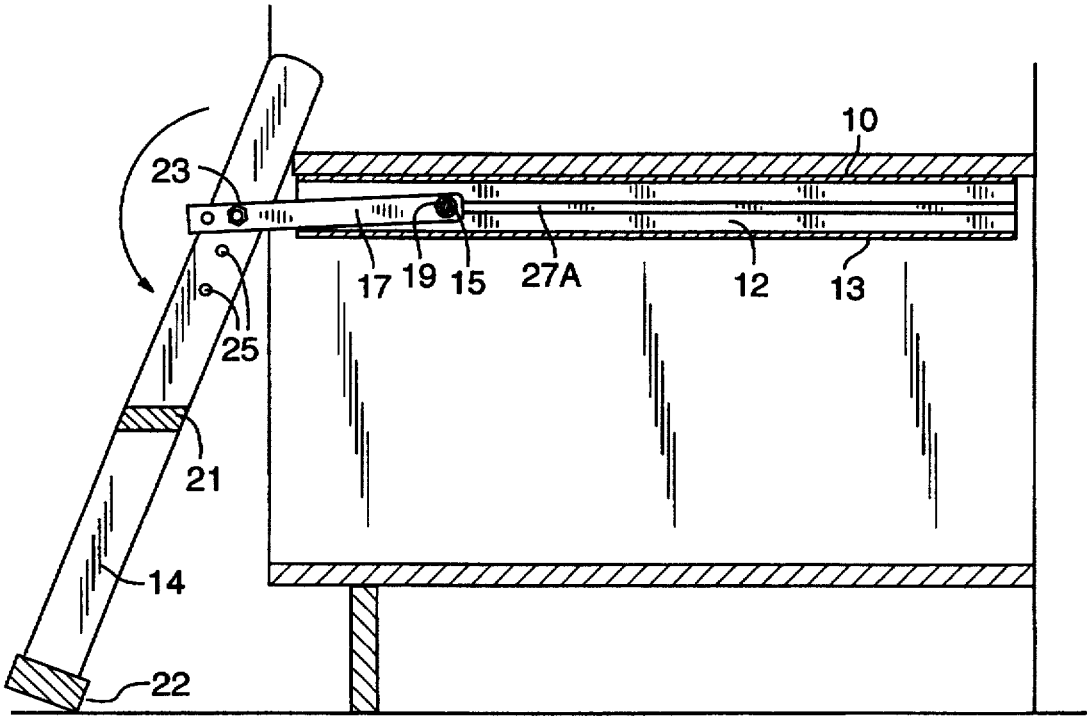
FIG. 3 of the drawings illustrates a sectional view of the ladder in the extended and deployed position with the housing fastened as in FIG. 2.
Figure 4:
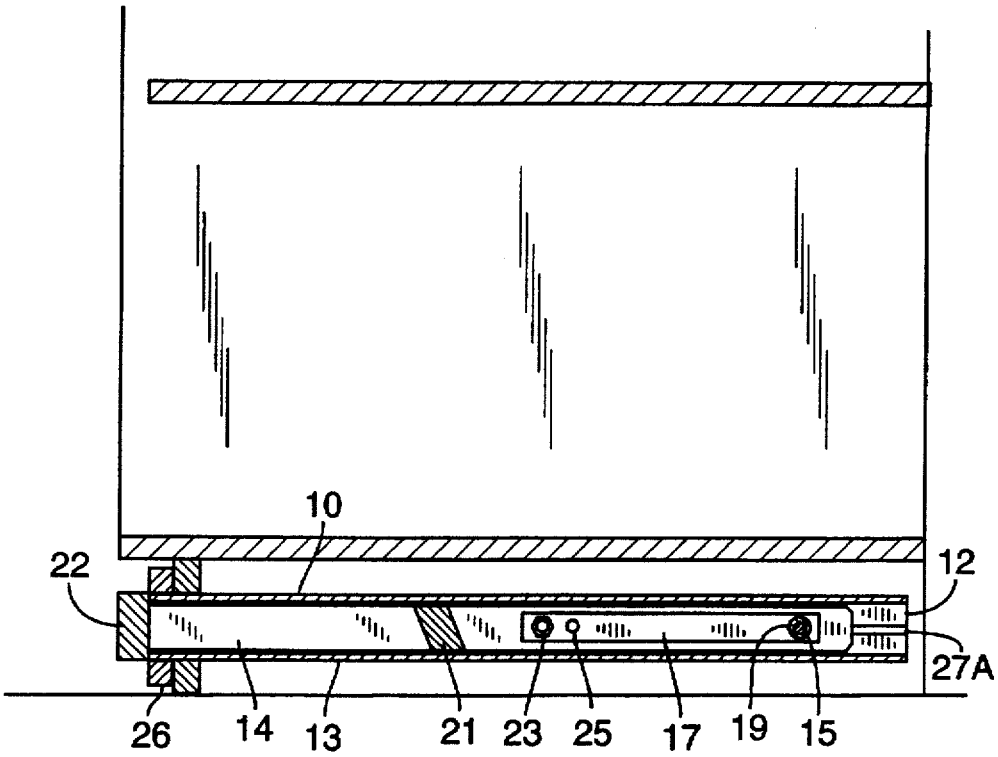
FIG. 4 of the drawings illustrates a sectional view of the ladder and housing with the ladder in the retracted and stowed position with the housing located between the lowest planary surface of a cabinet and the floor in the kick space with the face frame installed on the housing and attached to the kick plate.
Figure 5:
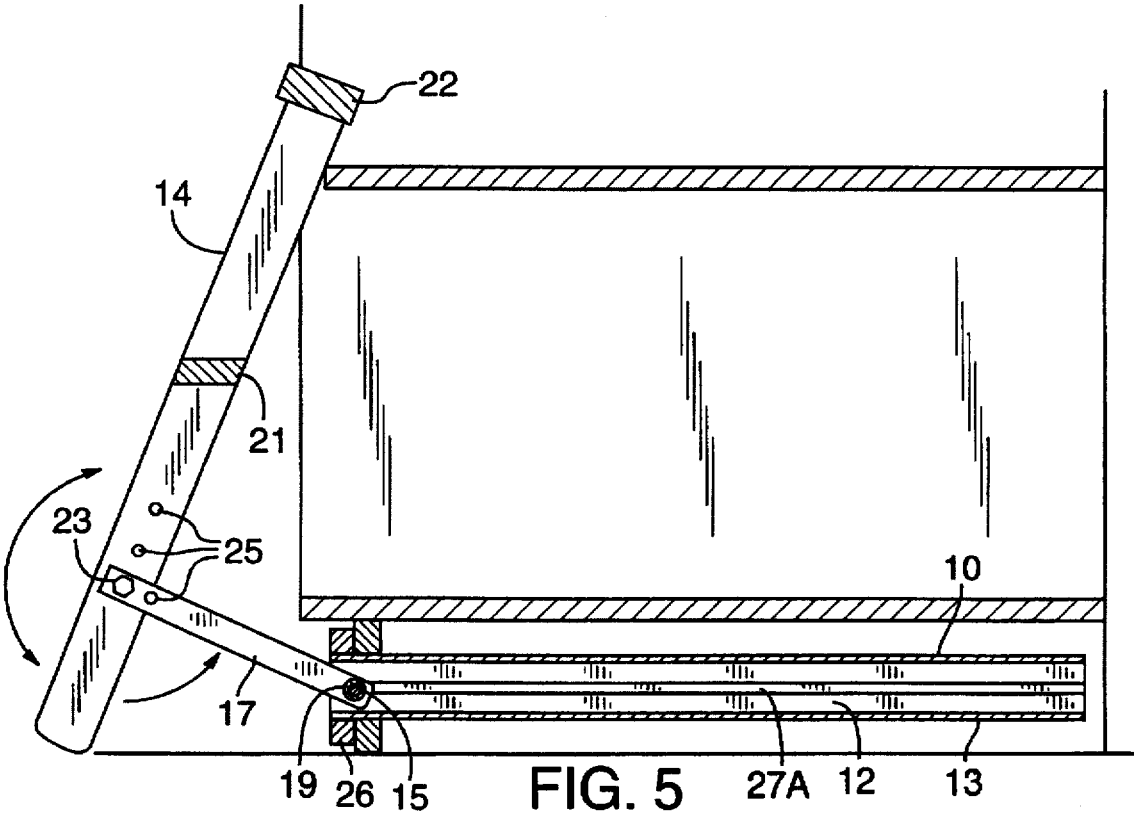
FIG. 5 of the drawings illustrates a sectional view of the ladder and housing with the ladder in the extended and deployed position with the housing and face frame installed as in FIG. 4.
Figure 6:
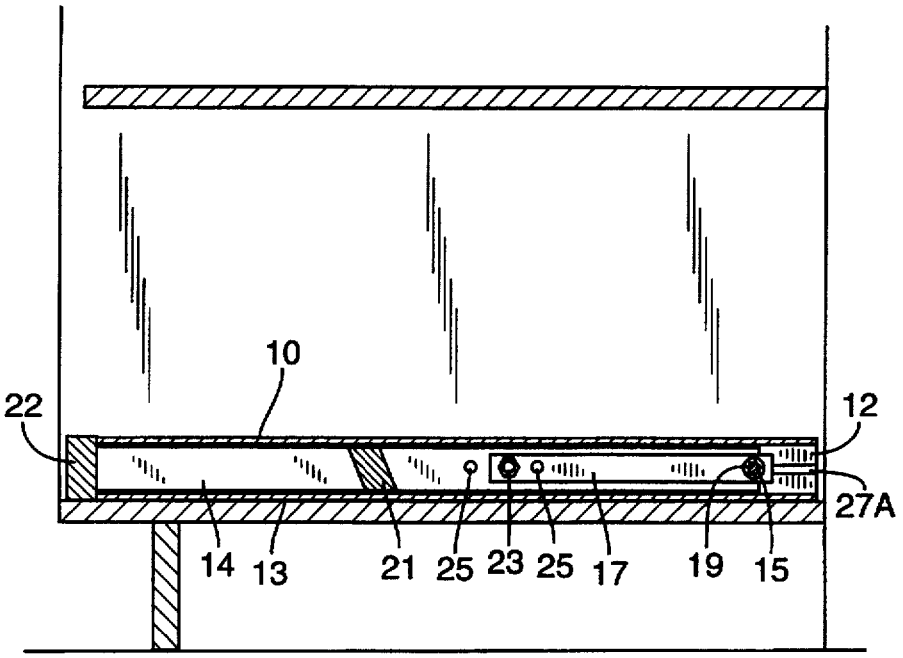
FIG. 6 of the drawings illustrates a sectional view of the ladder and housing with the ladder in the retracted and stowed position and the housing installed on the upper surface of the lowest planary surface of a cabinet and the face frame removed.
Figure 7:
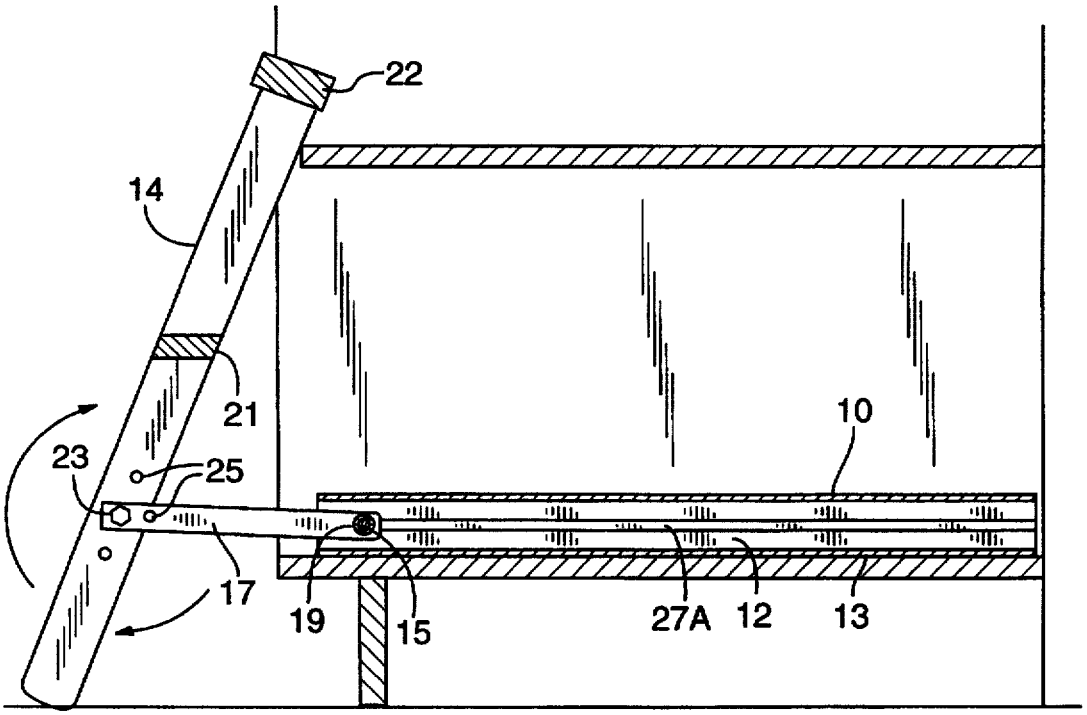
FIG. 7 of the drawings illustrates a sectional view of the ladder and housing with the ladder in the extended and deployed position and the housing installed as in FIG. 6.

When in the retracted and stowed position, the axle is traversed along the grooves in the housing side rails toward the ends of the side rails of the housing assembly, stopping when the rigid lateral end member (22) encounters either the face frame in the embodiment illustrated in FIG. 4, or when it encounters the housing as in FIGS. 2 and 6. When in the retracted and stowed position the ladder legs, hinges, and housing assembly are in approximately parallel horizontal planes and retained therein by gravitational force against a horizontal planary side of the housing.

Extension and deployment of the ladder assembly is accomplished by exerting extractive horizontal force on the rigid end member causing the ladder assembly to be withdrawn from the housing assembly and the axle to slide along the grooves in the side rails of the housing in the direction of said horizontal force. When the point at which the ladder legs are attached to the hinges clears the housing assembly, rotational force is exerted on the ladder legs and the ladder legs are rotated around the hinge attaching pins until a desired angular relationship is established in which one end of the ladder touches the floor and the opposite end of the ladder is supported by encountering a component of the support structure. The optimum angular relationship is achieved when the angle at which the ladder legs approach the floor is 25 to 30 degrees off of vertical, at which point the preponderance of a load is directed downward onto the floor.

A plurality of holes are present within the ladder legs and hinges so that the hinge attaching pins can be relocated to change the juxtaposition of the hinge and leg and thereby accommodate variations in location of the various elements of the support structure. By relocating the hinge attaching pins to accommodate conditions present when and where the assemblies are installed, and by sliding the axle to and fro within the groove, the angular relationships can be adjusted to approach the optimum. The stop created by the forward end of the grooves in the housing side rails prevents the axle from exiting the housing and prevents the ladder assembly from being completely separated from the housing.

The action of moving the ladder assembly into the retracted and stowed position is facilitated by reversing the rotational force bringing ladder legs, hinges, and housing assembly into parallel horizontal planes and exerting horizontal force to slide the ladder assembly, guided by the axle in the grooves, into the housing until the rigid end member stops against either the face frame or housing.

In the preferred embodiment of the invention, the housing assembly should measure approximately two and one quarter inches in thickness, thereby utilizing a minimal amount of space within the cabinet or other support stucture. Other dimensions are determined by the size of the independent support structure. Dimensions of the housing side rails should be sufficient to accommodate mounting screws or bolts without said screws or bolts encroaching on the axle groove. Other components should be sized to provide a maximization of the strength of the components without creating binding or undue friction in operation and without defeating the purpose and function of the invention. The vertical height above the floor of the upper surface of one rung or step should be at least 6" in order to provide a user an increase in height in an amount which the user finds utilitarian and desireable and the rung or step should be long enough between the ladder legs to at least accommodate the secure positioning of one of the users feet.

In the preferred embodiment of the invention it is envisioned that installation of the housing assembly would be accomplished as in FIG. 6 by means of a plurality of screws penetrating the housing side rails and engaging the underlying planary surface (bottom) of the support structure. Installation as in FIG. 2 would be accomplished by means of a plurality of bolts or machine screws penetrating the intermediate planary surface, or shelf, of the support structure and passing through the housing side rails with nuts and washers placed on the underside of the housing side rails and thereby securing the housing assembly under the shelf. Installation as in FIG. 4 would be accomplished by cutting a slot in the face of the kick plate slightly larger than the outside sectional dimension of the housing assembly with the face plate removed, placing loose block spacers of sufficient thickness to support the housing assembly parallel to the floor in line with the slot on the floor behind the kick plate, attaching the detachable face frame to the housing assembly with screws, placing the housing assembly through said slot, and attaching with screws the face frame to the face of the kick plate.

Each of these installations could be accomplished without specialized tools and without undue or prolonged disruption of the daily use of the cabinet.

There has thus been shown and described a novel and useful device that fulfills the objects and advantages sought therefore. Changes, modifications, variations, or other uses will, however, become apparent to those skilled in the art after considering these specifications, drawings, and descriptions. The foregoing description of the preferred embodiments of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but rather by the claims appended hereto.

The invention claimed is:

1. An extensible and stowable ladder for use in kitchen cabinets, bathroom vanities, kitchen appliances, cabinets and the like comprising:

a housing assembly for mounting on a horizontally disposed planary surface being part of an independent support structure, said housing assembly comprising two parallel side rail members and two parallel planary members which are fixedly joined in a manner that forms a rectangular compartment with the two side rail members forming two facing sides and the two planary members forming two facing sides; said side rail members having upon their facing surfaces a groove enscribed, said groove extending along the long axis of the facing surfaces essentially equidistant from the long edges of said side rail members and parallel thereto from one end of the side rail members to a point not at the opposing end; said side rail members when placed in their respective positions and affixed to the two planary members forming two sides are mirror images one of the other and form the remaining two sides of said rectangular compartment; AND a ladder assembly comprising a rigid end member fixedly attached to one end of each of two parallel leg members, said leg members being mirror images one of the other separated by a distance maintained and determined by the length of the rigid end member and along their length having at least one rigid intermediate member with its opposing ends fixedly attached to the opposing leg members spanning said maintained distance and retaining the parallel juxtaposition of said leg members, said leg members having along their length a plurality of spaced holes through their facing surfaces, said holes extending through the narrow dimension of said leg members and providing orifices through which pass a pair of hinge attachment pins said pins being round in cross section and of sufficient length and appropriate shape to provide a means of attaching a pair of hinge members one each to each said leg member at a location removed a distance from the end of the leg member to which the rigid end member is affixed, said hinge members being mirror images one of the other and having along their length a plurality of spaced holes one of which receives the hinge attachment pin and another of which serves as an orifice through which passes an axle which is round in cross section, the opposing ends of said axle are placed respectively in the grooves enscribed on the facing surfaces of the parallel housing side rail members in order that the ladder assembly be slidably joined to the housing assembly and contained within the compartment formed by the four sides of said housing and can be deployed from said housing without becoming detached from said housing into a configuration wherein one end of the ladder legs rests on a floor or other surface and the other end is leaned against a component of the independent support structure, the user can then stand on said rigid intermediate member to increase the users reaching height, then by exerting rotational and horizontal force stow the ladder assembly back inside the housing assembly compartment with said axle sliding along the groove in the housing side rail, said axle being equipped with spacers to approximately maintain alignment of the ladder leg members and hinge members.

2. The invention according to claim 1 wherein the housing assembly is equipped with a face frame to facilitate installation of the housing assembly within the space between a cabinet bottom or drawer and the floor.

* * * * *